US006079344A

United States Patent [19]

Wang et al.

[11] Patent Number: 6,079,344

[45] Date of Patent: Jun. 27, 2000

[54] SMALL WATERCRAFT WITH FIN AND SAIL

[76] Inventors: Rong-Shuang Wang, 609 Shives Way, Egg Harbor Township, N.J. 08234; Han-Sheng Wang, 1306 Bunker Hill Dr., Cherry Hill, N.J. 08003

[21] Appl. No.: 09/225,789

[22] Filed: Jan. 5, 1999

[51] Int. Cl.[7] ..... B63B 35/79; B63H 1/36

[52] U.S. Cl. ..... 114/39.21; 440/14

[58] Field of Search ..... 114/122, 123, 114/102.16, 153, 160, 132, 39.12, 39.22, 39.21, 343, 130; 440/14, 13

[56] References Cited

U.S. PATENT DOCUMENTS

| | | | |
|---|---|---|---|
| 190,283 | 5/1877 | Cole | 114/60 |
| 2,062,546 | 12/1936 | Wells | 115/28 |
| 4,345,903 | 8/1982 | Laser | 440/14 |
| 4,642,056 | 2/1987 | Keivanjah | 440/15 |
| 4,646,669 | 3/1987 | Frank | 114/39 |
| 4,960,396 | 10/1990 | Stolzer | 440/21 |
| 5,163,857 | 11/1992 | Hinsley | 440/14 |
| 5,584,732 | 12/1996 | Owen | 440/13 |

*Primary Examiner*—S. Joseph Morano
*Assistant Examiner*—Patrick Craig Muldoon

[57] ABSTRACT

A small watercraft, e.g. a small catamaran, propelled by a vertical fin-like device and/or a sail is invented. A vertical shaft is located in the front portion of the craft. Foot operated multiple arms are secured to the upper portion of the shaft. The fin is secured to a hinge which is located at the trailing end of an elongated member. The leading end of the elongated member is removably secured to a joint device at the lower end of the shaft. The arms, shaft, elongated member, and fin can rotate 360 degrees about the shaft axis. Depending on the general direction the elongated member is pointing to, the fin can propel and turn the watercraft. Because the shaft can rotate 360 degrees, the craft can also go backwards and turn at the radius less of its length. An opening between the fin and the operator is provided to allow the fin to be secured and removed during operation. The joint device also allows the fin together with the elongated member to pass up through the opening when the fin hit an object in the water. A stud is secured to the upper end of the shaft. The stud allows a sail mast to telescope on and the turning of the stud does not affect the mast or vice versa. A rudder is located at the rear end of the watercraft. Unless sailing at high wind, there is no need to control the rudder. A mechanism allows the rudder to turn upward when the rudder hits an object in the water.

8 Claims, 3 Drawing Sheets

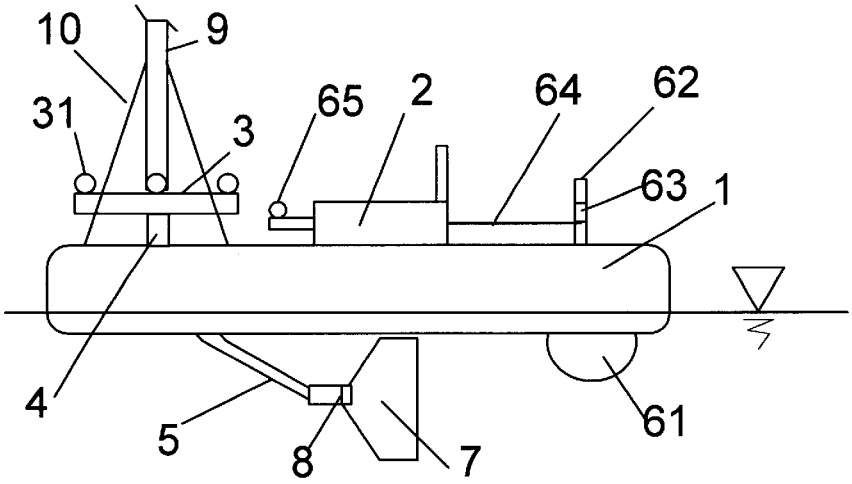
FIG. 1.1
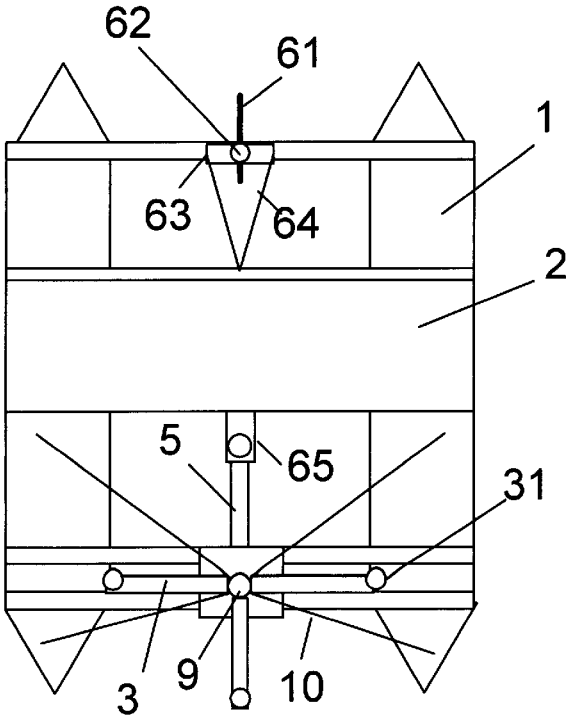
FIG. 1.2
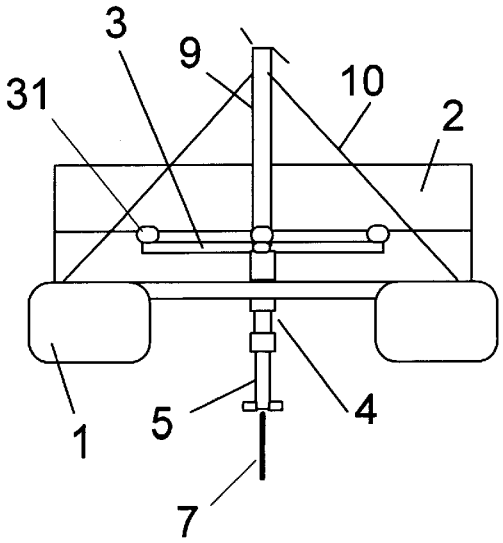
FIG. 1.3

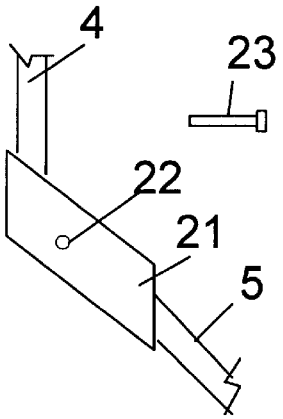
FIG. 2.1
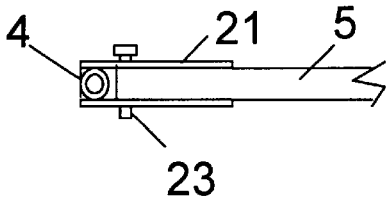
FIG. 2.2
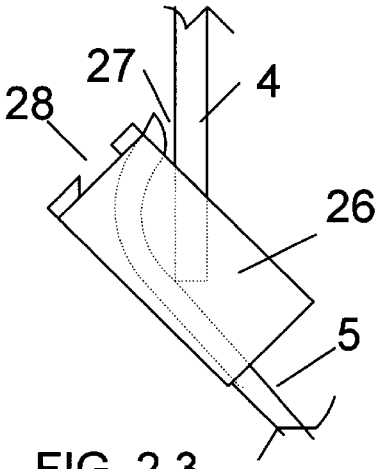
FIG. 2.3
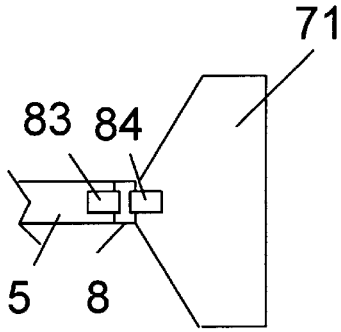
FIG. 3.1
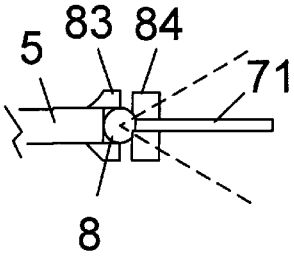
FIG. 3.2
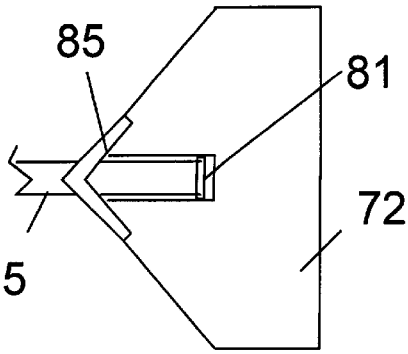
FIG. 3.3

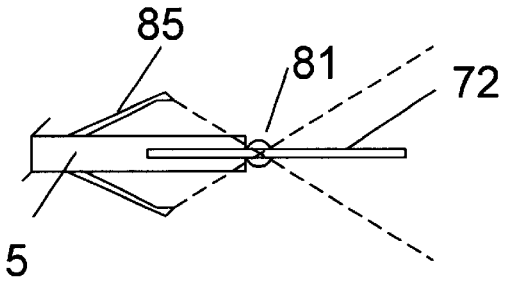
FIG. 3.4
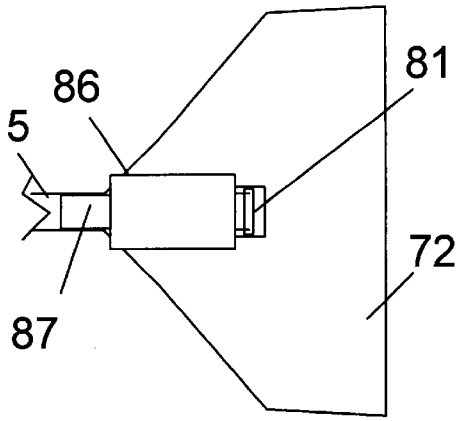
FIG. 3.5
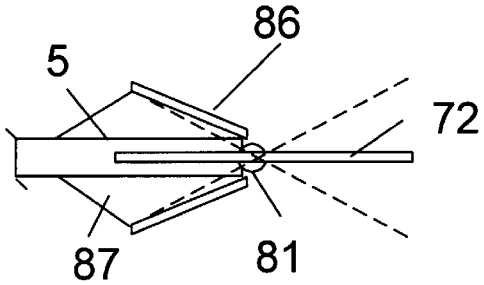
FIG. 3.6
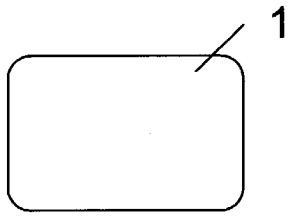
FIG. 4
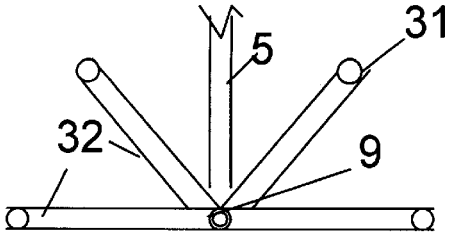
FIG. 5.1
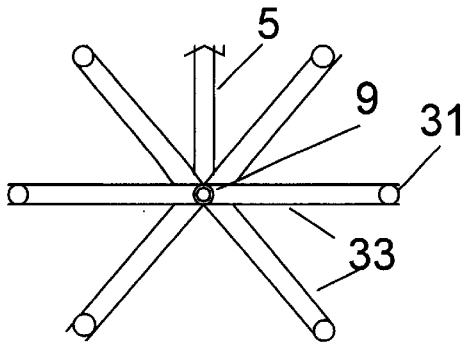
FIG. 5.2

SMALL WATERCRAFT WITH FIN AND SAIL

FIELD OF THE INVENTION

The present invention relates to a fin and/or sail propelled small watercraft. For convenience, the illustration of this invention uses a small catamaran as the model, but the invention is also applicable to a mono hull.

BACKGROUND OF THE INVENTION

For the one who does fishing on a small non-powered boat has a problem, i.e., he cannot do fishing and control the boat at the same time. For the one who sails a small boat also has a problem, i.e., his hands are basically occupied by the sail and rudder, and cannot be spared to do anything else, like fishing. There are inventions of different fin propelling boats. However, these inventions either have serious boat wiggling problem or need stationary fins to reduce the boat wiggling when the fin propels. This invention has solved all the problems.

OBJECTIVES OF THE INVENTION

The primary objective of this invention is to provide a small watercraft that can be propelled and steered by foot only.

Another objective of this invention is to allow the operator to propel and steer without stretching legs extensively.

A further objective of this invention is to allow the operator to easily free the fin when it bottoms.

Still another objective is to allow the fin to propel out of the place where it bottoms.

Still another objective of this invention is to reduce the chance of the fin being tangled by seaweed.

Yet another objective of this invention is to convert the fin-propelled watercraft into a sailboat with fin-propelling function by simply mounting a removable sail and using the fin as centerboard.

BRIEF DESCRIPTION OF THE DRAWINGS

FIG. 1.1 is the side view of the watercraft.

FIG. 1.2 is the top view of the watercraft.

FIG. 1.3 is the front view of the watercraft.

FIG. 2.1 is the side view of the configuration of a joint mechanism connecting the lower end of the shaft and the elongated member.

FIG. 2.2 is the top view of the configuration shown in FIG. 2.1.

FIG. 2.3 is the side view of the configuration of another joint mechanism connecting the elongated member and the shaft.

FIG. 3.1 is the side view of the configuration of a joint mechanism connecting the fin and the elongated member.

FIG. 3.2 is the top view of the configuration shown in FIG. 1.

FIG. 3.3 is the side view of the configuration of another joint mechanism connecting the fin and the elongated member.

FIG. 3.4 is the top view of the configuration shown in FIG. 3.3.

FIG. 3.5 is the side view of the configuration of yet another joint mechanism connecting the fin and the elongated member.

FIG. 3.6 is the top view of the configuration shown in FIG. 3.5.

FIG. 4 is the cross section view of the middle section of the float.

FIG. 5.1 is the top view of another configuration of the horizontal arms.

FIG. 5.2 is the top view of yet another configuration of the horizontal arms.

DETAILED DESCRIPTION OF THE INVENTION

FIG. 1.1 shows the side view of said watercraft. One float [1] is installed on each side of the watercraft. A position adjustable seat [2] is installed close to the center of buoyancy of the watercraft. A vertical shaft [4] is installed in the front portion of the watercraft. The lower end of the shaft [4] is connected to one end of an elongated member [5]. At the other end of the member [5], a vertical hinge [8] is installed. A vertical fin [7] is secured to said hinge [8]. The rotation of the fin [7] about the axis of the hinge [8] is limited. One pair of arms [3] is secured to the upper end of the shaft [4]. At the free end of each arm [3], a raised pedal [31] is installed for the operator to push the arm [3] by foot. The arms [3] turn the shaft [4], and the shaft [4] turns the elongated member [5]. When the arms [3] are pushed forward alternately, the fin [7] sways like a fish tail. The arms [3] together with the elongated member [5] can make 360-degree rotation. Depending on the direction that the elongated member [5] is generally pointing to, the fin [7] can propel the watercraft forward, backward, and make turns. A hand controlled rudder mechanism which consists of a rudder plate [61], rudder shaft [62], rudder head [63], cables [64], and control handle [65] is installed in the rear portion of the watercraft. Normally, when it is not sailing, the rudder mechanism is not used. Even, during sailing, the direction may be controlled by the fin [7] only. In a sense, the watercraft can be operated without using hand. The rudder shaft [62] almost equally divides the area of the rudder plate [61], with its trailing area slightly larger than the leading area. The rudder shaft [62] can be moved up and down such that the height of rudder plate [61] can be adjusted. The angle of the rudder plate [61] is controlled by the rudder head [63]. The rudder head [63] is connected to the two cables [64] which in turn are connected to the control handle [65] near the seat [2]. The control handle [65] is pivotally secured to watercraft and is used for remotely turning the rudder plate [61]. The operator has to overcome friction force at the handle [65] before he can turn it. Because the rudder plate [61] has almost the same area on each side of the rudder shaft [62], a slight friction at the control handle [65] will be sufficient to keep the rudder plate [61] in a desired direction without attendance. A removable sail mast [9] is installed right above the shaft [4]. The lower end of the mast [9] is held in place either by a cavity or a stud that may be formed by the upper end of the shaft [4]. The mast [9] is further secured to the body of the watercraft by four cables [10]. The mast [9] does not rotate about its axis when the shaft [4] rotates. When the watercraft sails, the fin [7] in the water acts like a centerboard. When there is not enough wind, one can use the fin [7] to propel and steer the watercraft with or without the mast [9] on. It is shown that when the elongated member [5] points to the rear end of the watercraft, the fin [7] is located generally right below the seat [2]. This positional arrangement of the fin [7] and the seat [2] can eliminate the wiggling of the watercraft when the fin [7] sways in the water. It also shows that the rudder shaft [62] points vertically down into the water.

FIG. 1.2 is the top view and FIG. 1.3 is the front view of the watercraft shown in FIG. 1.1.

FIG. 2.1 shows the side view of the configuration of a joint mechanism connecting the lower end of the shaft [4] and the elongated member [5]. A channel [21], which is secured to the shaft [4], is used to hold and sway the elongated member [5] during operation. Two horizontal pinholes [22] are provided on the walls of the channel [21]. A horizontal hole is provided at the leading end of the elongated member [5]. A removable pin [23], by inserting through the pinholes [22] and the horizontal hole, is used for keeping the end of the elongated member [5] in the channel [21] and the fin [7] in its upright position. The pin [23] is shown not inserted in this figure. The elongated member [5] will stay at the bottom of the channel [21] by its own weight. The operator can easily remove the pin [23] to remove the elongated member [5] and the fin [7]. The elongated member [5] tilts downward from the channel [21], and the lower profile of the elongated member [5] and the fin [7] are smoothed so that they won't catch objects, e.g. seaweed, during motion. To facilitate transportation of the watercraft on cars, and allow easy access of the elongated member [5] and the pin [23], the lower end of the channel [21] is situated above the bottom of the floats [1], and preferably above the water line (see FIG. 1.1). Between the shaft [4] and the center of the watercraft, an opening is provided to allow the operator to access the elongated member [5]. The shaft [4] can also be raised for easy access of the elongated member [5]. During operation, if the fin [7] or the elongated member [5] hits an obstruction in the water, e.g. ground, rock, tree stump, etc., the fin [7] together with the elongated member [5] can easily pop up (rotate about the pin [23]), thus will have less chance being damaged. After the obstruction is passed, the elongated member [5] will drop back to the bottom of the channel [21] by its own weight.

FIG. 2.2 shows the top view of the shaft [4], channel [21], pin [23], and the elongated member [5] shown in FIG. 2.1.

FIG. 2.3 is the side view of the configuration of an alternative joint mechanism connecting the shaft [4] and the elongated member [5]. The leading end of the elongated member [5] in this joint configuration is curved. A channel [26] is secured to the lower end of the shaft [4]. The leading end of the channel [26] is partially blocked leaving two openings [27] and [28]. To install the elongated member [5], one has to lift the fin end of the member [5] and slide the curved end into and up in the channel [26] and let the member [5] drop down in the channel [26]. For full fin operation (normal operation), the leading end of the elongated member [5] is lodged in the opening [27] of the channel [26]. For partial fin operation (shallow water operation), the leading end is lodged in the opening [28]. For both operations, the elongated member [5] is down in the channel [26]. The curved portion of the elongated member [5] in the channel [26] keeps the fin [7] in its upright position. The lower end of the shaft [4] holds the curved end of the elongated member [5] in the channel [26]. To release, one just reverses the installation process. This alternative joint does not use pin and serves the same purpose of the joint shown in FIG. 2.1

FIG. 3.1 shows the configuration of a fin joint mechanism. One wing of the hinge [8] is secured to the elongated member [5], the other is secured to a fin [71]. When the elongated member [5] sways, two stoppers [83] and [84] ensure a limited rotation of the hinge [8] thus to achieve a controlled angle of attack for the fin [71]. The two stoppers can be installed on the elongated member [5] and the fin [71], or can be integral parts of the hinge [8].

FIG. 3.2 is the top view of the configuration shown in FIG. 3.1. The dash lines show the angular limitation that the fin [71] can rotate about the axis of the hinge [8].

FIG. 3.3 shows the side view of the configuration another fin joint mechanism. The fin [72] has a notched opening toward the center of the fin [72]. A hinge [81] is secured at the end of the opening. The fin area between the outer edge of the fin [72] and the hinge [81] is larger than the area between the inner edge (the edge close to the elongated member [5]) of the fin [72] and the hinge [81] such that when the elongated member [5] sways, the fin [72] will turn to the desired angle of attack. The rotation of the fin [72] about the axis of the hinge [81] is limited by two pairs of stopper [85] secured on the elongated member [5]. The stopper [85] can also prevent the fin [72] from catching objects, like seaweed. At the end of one sway, when the operator reverses the sway direction, with a given fin size, this hinge location arrangement will reduce the distance that the hinge [72] travels in the water to have the fin [72] completely reversed its angle of attack. The distance reduction will increase the amount of fin propelling time, i.e. the power delivered by the fin can be increased.

FIG. 3.4 is top view of the configuration shown in FIG. 3.3. The dash lines show the angular limitation the fin [72] can rotate about the axis of the hinge [81].

FIG. 3.5 shows the side view of the configuration of yet another fin joint mechanism whereas the fin [72] and the hinge [81] have the same configuration as shown in FIG. 3.3. A triangular block [87] is installed on each side of the elongated member [5] and near the hinge [81]. A plate stopper [86] is installed on the trailing wall of each block [87]. The stopper [86] can limit the rotation of the fin [72] about the axis of the hinge [81] and cover the notched opening of the fin [72] when the fin [72] sways. The configuration will further increase the power the fin [72] can deliver.

FIG. 3.6 is the top view of the configuration shown in FIG. 3.5. The dash lines show the angular limitation the fin [72] can rotate about the axis of the hinge [81].

FIG. 4 shows the cross section of the middle section (other than the bow and stem) of the float [1]. The cross section is generally rectangular in shape. The vertical and horizontally straight walls of this configuration (also shown in FIG. 1.2) will reduce the side way motion of the watercraft when the fin [7] sways and keep the watercraft in its course. FIG. 5.1 shows the top view of another configuration of horizontal arms [32]. Without changing the sitting position and/or stretching legs, the operator can select and push any two arms, one on each side of the elongated member [5], to change the direction the fin [7] propels. This easily and effectively change the direction the watercraft moves. One can operate the watercraft with the arms [32] much easier than with single pair of arms [3] shown in FIG. 1.2. The foot pedals [31] are also installed at the free end of each arm [32] for easy operation.

FIG. 5.2 shows the top view of yet another configuration of horizontal arms [33]. The configuration, like the horizontal arms [32], makes the operation even easier.

Although this invention has been described with a certain degree of particularity, it is to be understood that the present disclosure has been made by way of example only and that numerous changes in the detailed construction may be resorted to without departing from the spirit and scope of the invention as hereinafter claimed.

I claim:

1. A small watercraft comprising one or two floats; four or more horizontal arms which are scoured to an upper end of a shaft vertically pivoted in an front portion of said watercraft body; a joint device being secured to a lower end of the shaft; an elongated member with a leading end being removably secured during operation to the shaft by said joint device and with a trailing end a hinge being installed; a vertical fin being secured to the hinge; stoppers being used to limit the rotation of the fin about an axis of said hinge; said elongated member being allowed to make 360-degree rotation about the axis of said shaft when the arms turn; when said elongated member points to a rear end of the watercraft, said fin being located generally below a seat which is on or close to the center line of buoyancy of said watercraft; an opening being made from the shaft to a center portion of the watercraft to allow the fin to pass up and the installation and removal of the elongated member during operation.

2. A watercraft according to claim 1, wherein a means on the top of said shaft keeps a removable sail mast in place and not rotating with the shaft.

3. A watercraft according to claim 1, wherein lateral wails of a middle portion of said floats are generally vertical.

4. A watercraft according to claim 1, wherein said joint device has a general form of a channel having two pin holes on the channel walls whereas the leading end of said elongated member has a horizontal hole, whereas a removable pin being used to secure the leading end of said elongated member in the channel by inserting through said pin holes and the horizontal hole at the leading end of said elongated member.

5. A watercraft according to claim 1, wherein said fin has a notched opening toward a middle portion of the fin and said hinge being installed at an end of the opening, whereas the rotation of the fin about the axis of said hinge is controlled by said stoppers exerting at a portion of the fin between said hinge and an edge close to the elongated member.

6. A watercraft according to claim 1, wherein said stoppers are integral parts of the hinge.

7. A watercraft according to claim 1, wherein a rudder is installed at the rear end of the watercraft.

8. A watercraft according to claim 2, wherein the means is a stud.

* * * * *